US008424999B2

(12) United States Patent
Kato

(10) Patent No.: US 8,424,999 B2
(45) Date of Patent: Apr. 23, 2013

(54) RECORDING APPARATUS

(75) Inventor: Hideaki Kato, Ogaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 454 days.

(21) Appl. No.: 12/715,381

(22) Filed: Mar. 1, 2010

(65) Prior Publication Data

US 2010/0226040 A1 Sep. 9, 2010

(30) Foreign Application Priority Data

Mar. 3, 2009 (JP) ..... 2009-049234

(51) Int. Cl.
*B41J 2/165* (2006.01)

(52) U.S. Cl.
USPC ..... 347/27

(58) Field of Classification Search ..... 347/20, 347/27, 42
See application file for complete search history.

(56) References Cited

U.S. PATENT DOCUMENTS

| | | | | |
|---|---|---|---|---|
| 7,025,431 | B2 * | 4/2006 | Ikeda et al. | 347/4 |
| 2008/0198196 | A1 | 8/2008 | Chikamoto | |
| 2011/0013204 | A1 | 1/2011 | Nakagaki | |

FOREIGN PATENT DOCUMENTS

| | | | |
|---|---|---|---|
| JP | 2005-047010 | A | 2/2005 |
| JP | 2007-181991 | A | 7/2007 |
| JP | 2008-200849 | A | 9/2008 |
| JP | 2009-012405 | A | 1/2009 |

* cited by examiner

*Primary Examiner* — Kevin S Wood
(74) *Attorney, Agent, or Firm* — Baker Botts L.L.P.

(57) ABSTRACT

A recording apparatus includes: a recording head which conducts recording onto a printing medium; a supporter which supports the recording head at a recording position; and a vibration damper interposed between the recording head and the supporter. The recording head includes a recording surface facing a printing medium and a gradient inclined relative to the recording surface. The gradient is provided at an end of the recording surface. The vibration damper abuts: at least one of the recording surface and a surface parallel to the recording surface of the recording head; and the gradient.

9 Claims, 9 Drawing Sheets

RECORDING APPARATUS

CROSS REFERENCE TO RELATED APPLICATION

This application claims priority from Japanese Patent Application No. 2009-049234, which was filed on Mar. 3, 2009, the disclosure of which is herein incorporated by reference in its entirety.

BACKGROUND OF THE INVENTION

1. Field of the Invention

The present invention relates to a recording apparatus which records an image onto a printing medium.

2. Description of Related Art

In an ink-jet recording apparatus, for example, vibration caused at the time of driving a recording head may degrade recording quality. In order to alleviate this problem, there has been a known technique of providing a vibration absorber between the recording head and a holder which holds the recording head.

SUMMARY OF THE INVENTION

According to the above technique, an effect of dampening vibration in a direction perpendicular to a recording surface of the recording head is expectable, however, it is difficult to effectively dampen vibration in a direction parallel to the recording surface. That is, the above technique is not able to effectively prevent degradation in recording quality caused by the vibration in this direction.

An object of the present invention is to provide a recording apparatus which effectively dampens vibration not only in the direction perpendicular to the recording surface but also in the direction(s) parallel to the recording surface and is excellent in preventing degradation in recording quality.

According to an aspect of the present invention, provided is a recording apparatus includes: a recording head which conducts recording onto a printing medium; a supporter which supports the recording head at a recording position; and a vibration damper interposed between the recording head and the supporter. The recording head includes a recording surface facing a printing medium and a gradient inclined relative to the recording surface. The gradient is provided at an end of the recording surface. The vibration damper abuts: at least one of the recording surface and a surface parallel to the recording surface of the recording head; and the gradient.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes preferred embodiments of the present invention with reference to drawings.

First, referring to FIG. 1, description will be given on general structure of an ink jet printer 1 of a first embodiment of the present invention.

Figure 1:
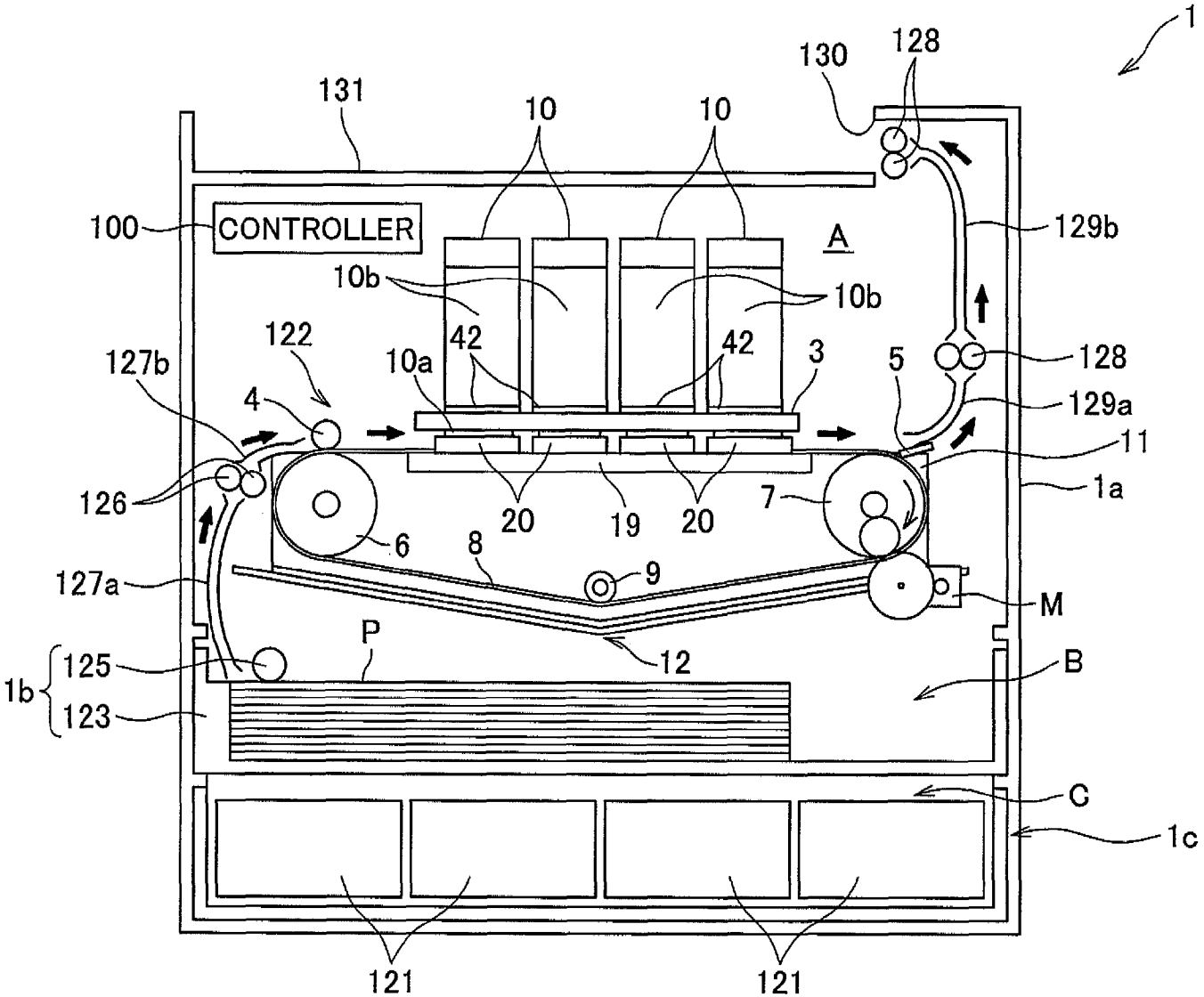
FIG. 1 is a cross-sectional side view of an ink jet printer of a first embodiment of the present invention.

As shown in FIG. 1, the printer 1 has a housing 1*a* of a rectangular parallelepiped shape. On the top panel of the housing 1*a*, a discharged paper receiver 131 is formed, which receives a sheet P having received recording thereon and discharged from an opening 130. The internal space of the housing 1*a* is divided into spaces A, B, and C, from the top to the bottom. The space A contains: four ink jet heads 10 which respectively eject different colors of ink of magenta, cyan, yellow, and black; a conveyor unit 122 which conveys a sheet P (a printing medium); and a controller 100 which controls operation of each component of the printer 1. The heads 10 are disposed so that the longitudinal direction of each head 10 is parallel to a main scanning direction. The conveyor unit 122 conveys a sheet P in a sub scanning direction. In the spaces B and C, a paper feed unit 1*b* and an ink tank unit 1*c* are disposed, respectively. Both of the units 1*b* and 1*c* are removable from the housing 1*a* in the main scanning direction.

Figure 2:
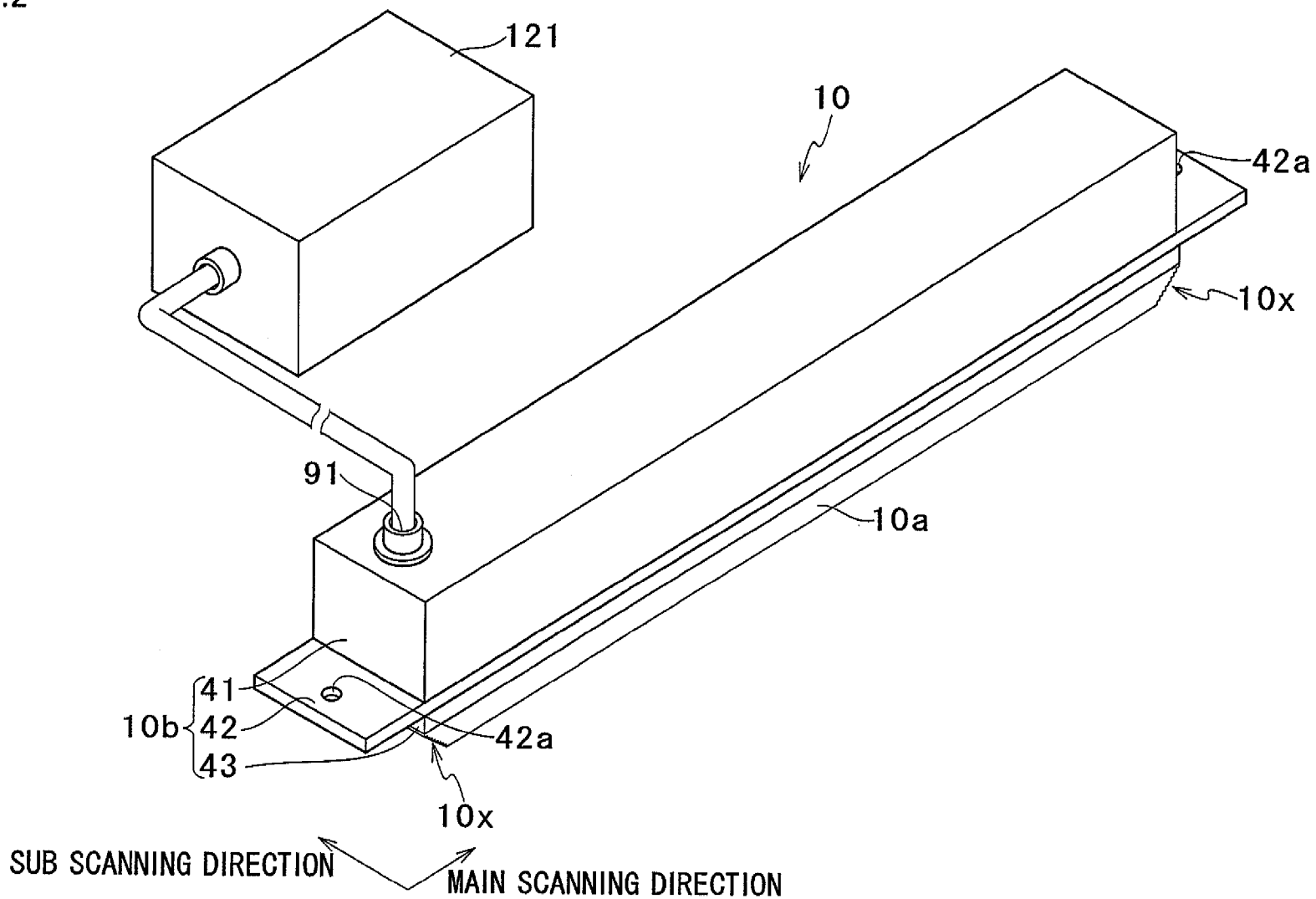
FIG. 2 is a perspective view illustrating one ink jet head included in the printer.

The ink tank unit 1*c* includes four main tanks 121 which contain respective colors of ink corresponding to the four heads 10. Each of the main tanks 121 is connected to the corresponding head 10 via a tube, as shown in FIG. 2.

The paper feed unit 1*b* has: a paper feed tray 123 which contains a plurality of sheets P; and a paper feed roller 125 attached to the paper feed tray 123. Starting from a topmost sheet P, the sheets P in the paper feed tray 123 are sequentially sent out by the paper feed roller 125, and then sent to the conveyor unit 122, while being guided by guides 127*a* and 127*b* and gripped by a pair of feed rollers 126.

The conveyor unit 122 has: two belt rollers 6 and 7; an endless conveyor belt 8 looped around the rollers 6 and 7; a tension roller 9 which contacts the internal surface of the lower loop of the conveyor belt 8 and exerts a downward force to the internal surface, thereby applying tension to the conveyor belt 8; and a support frame 11 which supports the rollers 6, 7, and 9 rotatably. As the belt roller 7 acting as a driving roller rotates in a clockwise direction in FIG. 1, the conveyor belt 8 travels and the belt roller 6 acting as a driven roller also rotates in the clockwise direction in FIG. 1. To the roller 7, a driving force from a conveyor motor M is transmitted via several gears.

A platen 19 is disposed in the loop of the conveyor belt 8. The platen 19 supports the upper loop of the conveyor belt 8. This allows a surface of the upper loop of the conveyor belt 8 to extend parallel to under surfaces of the four heads 10 (hereinafter the under surfaces are referred to as "recording surfaces") while keeping a predetermined distance d (see FIG. 5A) from the recording surfaces. The platen 19 supports a sheet P via the conveyor belt 8, in such a manner that the sheet P faces the recording surfaces of the heads 10. The recording surface of each head 10 is an under surface of a later-described passage unit 10*a*, and has a plurality of ejection openings each ejecting ink.

The four heads 10 extending parallel to one another are arranged in the sub scanning direction, and fixed to a pair of rod-like holders 3 each having its length in the sub scanning direction. The holders 3 are respectively located on both sides of the conveyor belt 8 and the platen 19 in the main scanning direction so as to sandwich the conveyor belt 8 and the platen 19 in a plan view. The holders 3 are supported by the housing 1*a* via a not-shown up-down movement mechanism in such a manner that the holders 3 are movable in an up-down direction (a direction perpendicular to the recording surfaces). As the controller 100 controls the not-shown up-down movement mechanism so as to drive, the pair of holders 3 holding the heads 10 are moved in the up-down direction, and thereby the four heads 10 are also moved relative to the housing 1*a* in the up-down direction. As described later, this enables the heads 10 to selectively take a recording position (a position at the time of recording, as shown in FIGS. 1 and 5A) and a withdrawal position (a position at the time other than recording, e.g., at the time of maintenance or the like, as shown in FIG. 5B) which is above the recording position.

Figure 5A:
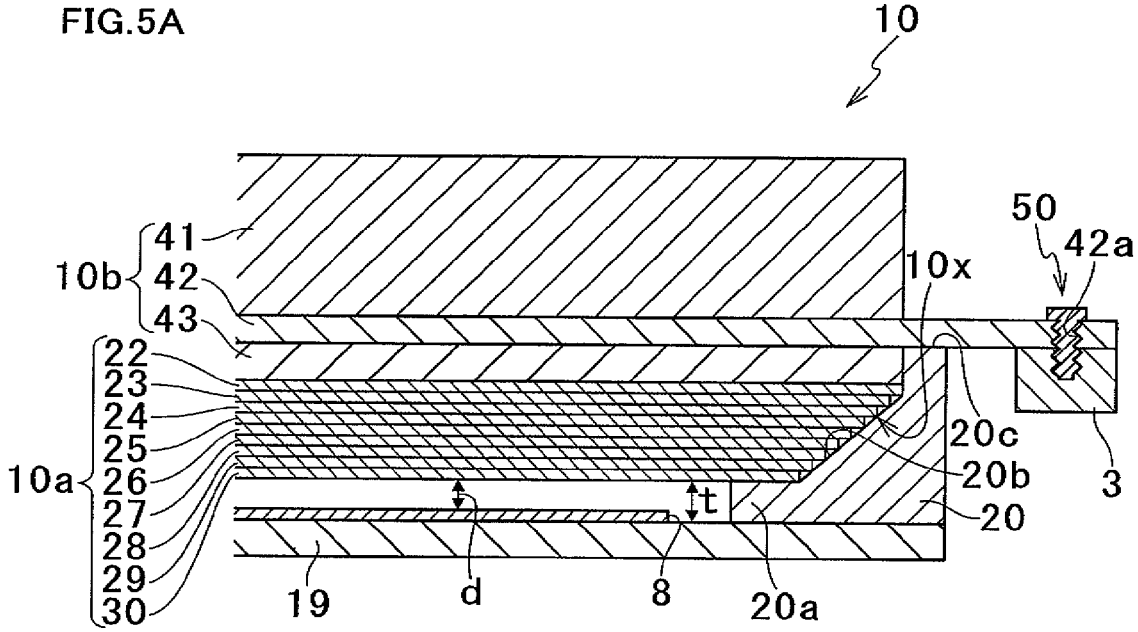
FIG. 5A is a sectional view taken along line VA-VA of FIG. 4, illustrating a state where the heads are in a recording position.
Figure 5B:
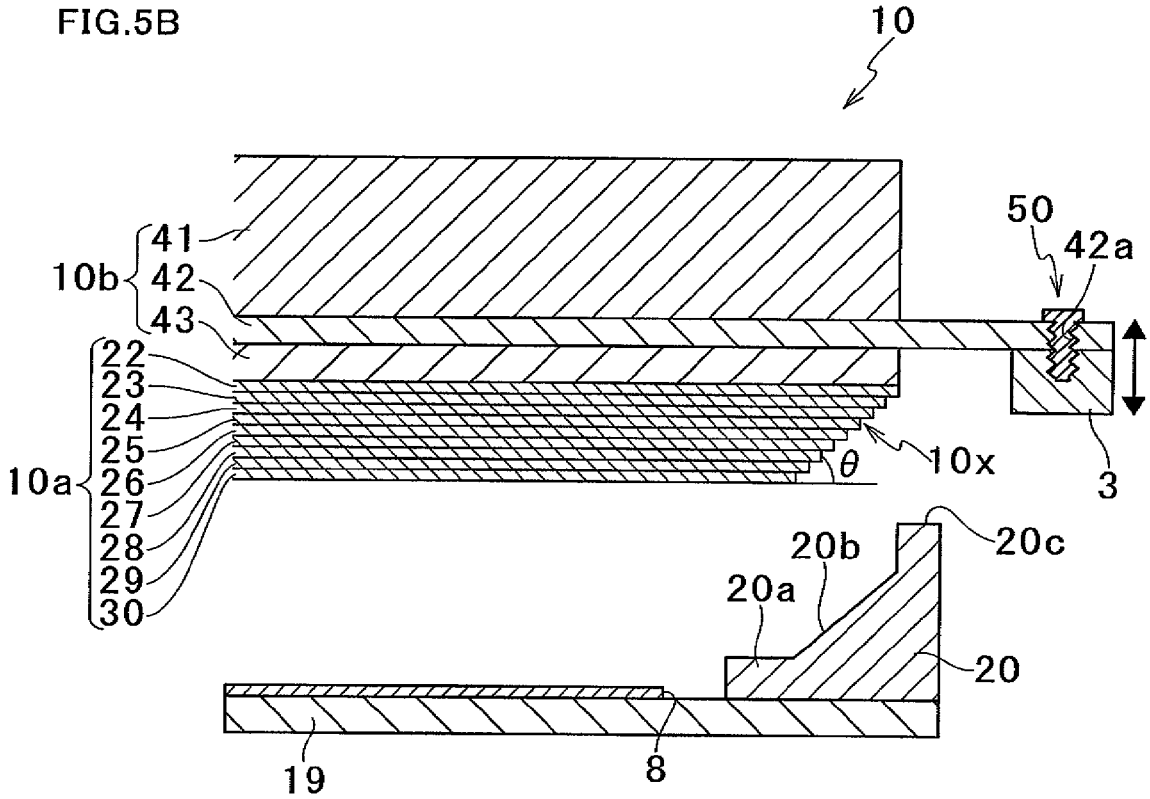
FIG. 5B is a diagram illustrating a state where the heads have been moved from the recording position of FIG. 5A to a withdrawal position, which is above the recording position.

When the heads 10 are at the recording position shown in FIG. 5A, the heads 10 are supported by the platen 19 via elastic members 20. When the heads 10 are at the withdrawal position shown in FIG. 5B, the heads 10 are not supported by the platen 19 and are apart from the platen 19 and the elastic members 20. Each elastic member 20 is a member made of elastic material such as rubber.

Below the conveyor unit 122, there is disposed a fall prevention plate 12 bended into a V-like shape. The fall prevention plate 12 receives a foreign matter falling from a sheet P, the conveyor belt 8, or the like.

A silicon layer with low adhesiveness is formed on a surface of the conveyor belt 8. A sheet P sent to the conveyor unit 122 is pressed by a pressing roller 4 onto the surface of the conveyor belt 8, and then the sheet P is conveyed in the sub scanning direction along solid black arrows, while being held on the surface of the conveyor belt 8 by the adhesiveness of the surface.

The different colors of ink is sequentially ejected from the recording surfaces of the respective heads 10 to an upper surface of the sheet P when the sheet P passes immediately below the four heads 10, and thereby a desired color image is formed on the sheet P. Then, the sheet P is peeled off from the surface of the conveyor belt 8 by a peel plate 5, and is conveyed upward while being guided by guides 129*a* and 129*b* and gripped by two pairs of feed rollers 128. After that, the sheet P is discharged to the discharged paper receiver 131 from the opening 130 formed at a top of the housing 1*a*.

Next, the structure of each head 10 will be described in detail with reference to FIGS. 1 to 5A, 5B.

As shown in FIG. 2, each head 10 has its length in the main scanning direction (a width direction of a sheet P), and is not moved relative to the housing 1*a* when conducting recording onto a sheet P conveyed by the conveyor unit 122. That is, the heads 10 are line heads.

As shown in FIGS. 1 and 2, each head 10 includes the passage unit 10*a* and a reservoir unit 10*b*, in this order from the bottom to the top.

Figure 3:
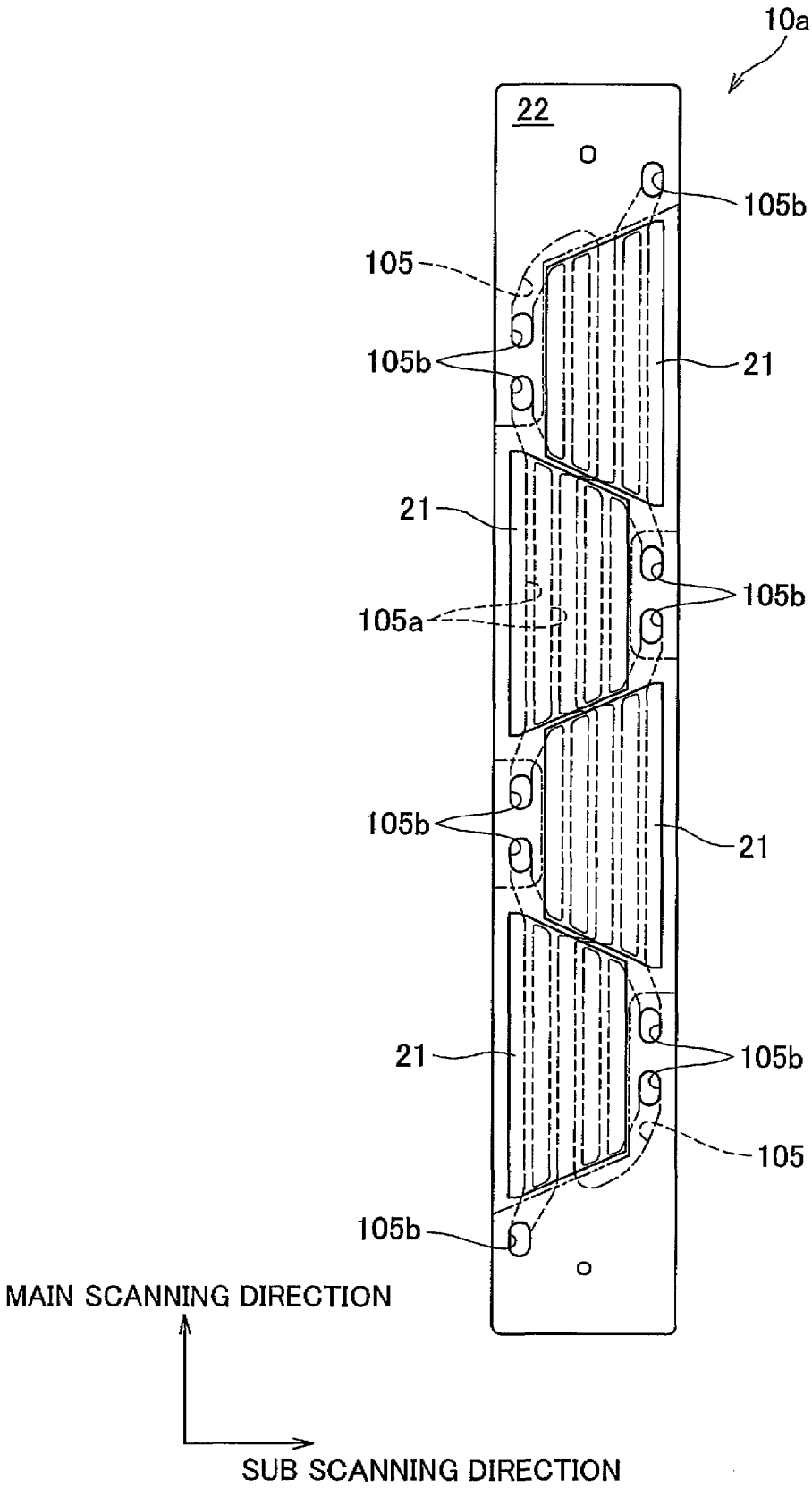
FIG. 3 is a plan view illustrating a passage unit of the head.

The passage unit 10*a* is formed of nine plates 22, 23, 24, 25, 26, 27, 28, 29, and 30 (see FIG. 5A) which are stacked on top of one another and bonded to one another. Although not illustrated in the drawings, each of the plates 22 to 30 has through holes and/or recesses formed therein. The plates 22 to 30 are stacked on top of one another while being aligned with one another, and thereby, ink passages are formed in the passage unit 10*a*, as shown in FIG. 3. In each ink passage, ink flows from an opening 105*b*, passes through a manifold channel 105 and a sub-manifold channel 105*a* which is a branch of the manifold channel 105, further passes through an aperture and a pressure chamber, and reaches an ejection opening.

On an upper surface of the passage unit 10*a*, four actuator units 21 each having a trapezoidal shape are fixed (see FIG. 3) so as to cover a plurality of pressure chambers which open on the upper surface. In addition, openings 105*b* are formed in a region of the upper surface of the passage unit 10*a*, where the actuator units 21 are not fixed. A region of an under surface of the passage unit 10*a*, which region vertically overlaps each actuator unit 21, is an ejection region having a plurality of ejection openings. Each actuator unit 21 includes piezoelectric actuators corresponding to the respective ejection openings.

The reservoir unit 10*b* is fixed to the passage unit 10*a*, establishing contacts between them at portions of the upper surface of the passage unit 10*a*, where the actuator units 21 are not bonded (regions partitioned by alternate long and two short dashes lines in FIG. 3, each of which regions includes the openings 105*b*). The reservoir unit 10*b* faces the actuator units 21 with a small gap therebetween. The reservoir unit 10*b* temporarily reserves therein ink supplied from the corresponding main tank 121, and supplies the ink to the passage unit 10*a* through the openings 105*b*.

As shown in FIG. 2, the reservoir unit 10*b* has: an upper reservoir 41 made of resin; a lower reservoir 43 including a plurality of metal plates stacked on top of one another; and a rectangular reservoir base plate 42. The reservoir base plate 42 is disposed between the upper reservoir 41 and the lower reservoir 43, and its length in the main scanning direction is longer than that of the upper reservoir 41 or the lower reservoir 43. A joint 91 is fixed to an upper surface of the upper reservoir 41. To the joint 91, a tube connected to the corresponding main tank 121 (see FIG. 1) is attached, and ink is supplied from the main tank 121 into the upper reservoir 41 via the tube and the joint 91. In the upper reservoir 41, a not-shown reservoir is formed which temporarily reserves the thus supplied ink. Although not illustrated in the drawings, the reservoir base plate 42 and each of the plates constituting the lower reservoir 43 have through holes and/or recesses which constitute passages for ink flowing from the reservoir to the passage unit 10*a*.

The reservoir base plate 42 has through holes 42*a* respectively located in the neighborhoods of both ends of the plate 42 in the main scanning direction. Each reservoir base plate 42 is fixed to the holders 3 with screws 50 (see FIGS. 4 and 5A) or the like inserted into the respective through holes 42*a*. As a result, the whole heads 10 are held by the holders 3.

As shown in FIG. 2, the passage unit 10*a* has gradients 10*x* at its respective ends in the main scanning direction, each of which gradients 10*x* is inclined relative to the under surface of the passage unit 10*a*. As shown in FIG. 5B, in a section along the main scanning direction, each gradient 10*x* is inclined relative to the under surface of the passage unit 10*a* at an inclination angle θ of approximately 30 degrees. As shown in FIG. 5B, the plates 22 to 30 constituting the passage unit 10*a* differ from one another in the length in the main scanning direction. Specifically, the lower a plate is positioned, the shorter its length in the main scanning direction is. The gradients 10*x* are formed of the respective ends of the plates 22 to 30 in the main scanning direction, into a stair-like configuration. Among the plates 22 to 30, the plate 30 has the shortest length in the main scanning direction. Each of the plates 22 to 29 stacked on the plate 30 has two ends each protruding outward in the main scanning direction beyond a corresponding end of a lower adjacent plate.

The following describes, in detail, how the heads 10 are supported, with reference to FIGS. 1, 4, 5A, and 5B.

As described above, at the recording position shown in FIG. 5A, each head 10 is supported by the platen 19 via the elastic members 20. At this time, the elastic members 20 are interposed between each head 10 and the platen 19.

Figure 4:
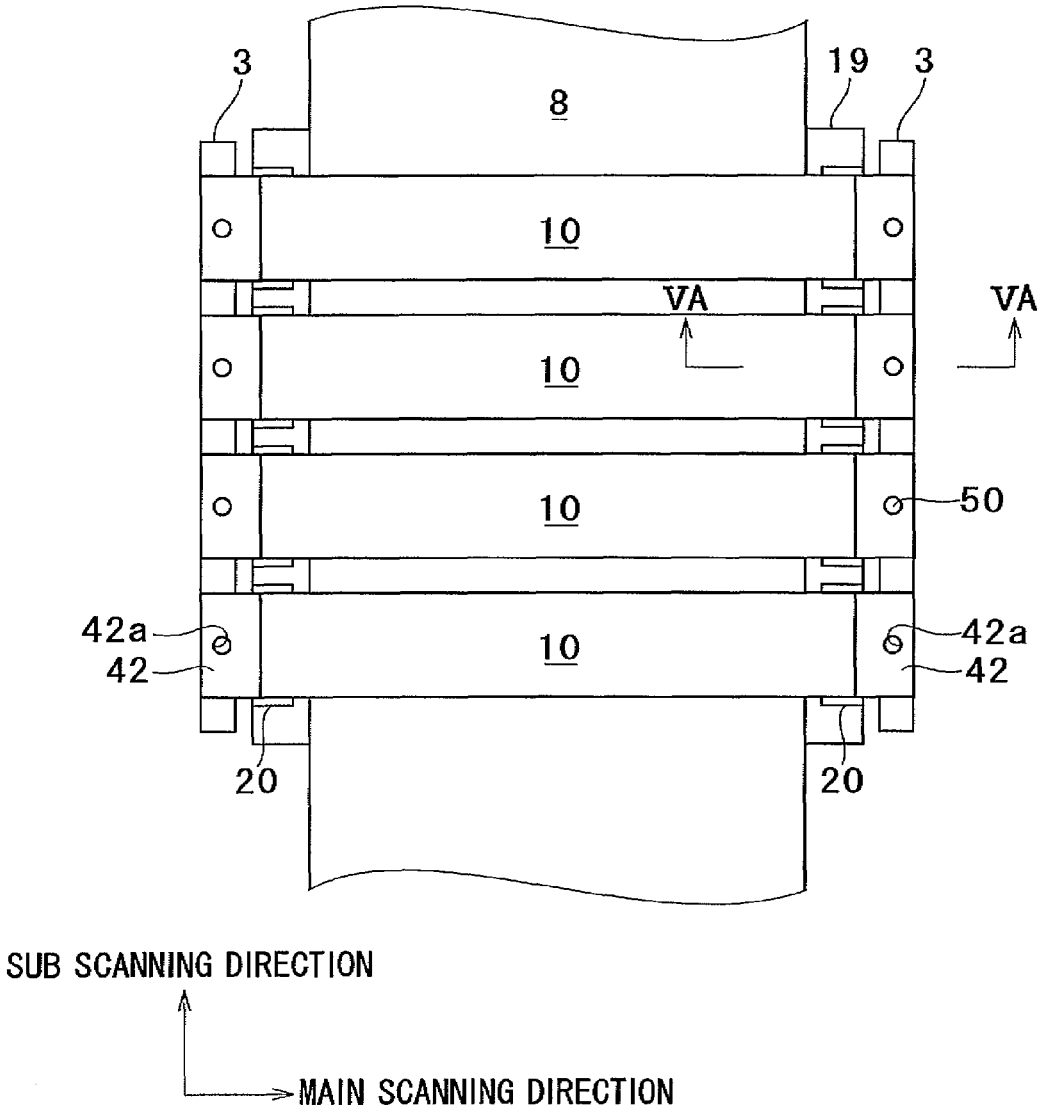
FIG. 4 is a plan view illustrating a region where four heads are disposed in the printer.

The platen 19 is a quadrangular plate having the following structure: as shown in FIGS. 1 and 4, the length of the platen 19 in the sub scanning direction is longer than that of a region where the four heads 10 are disposed; and as shown in FIGS. 4 and 5A, the length of the platen 19 in the main scanning direction is slightly longer than that of each head 10 (excluding its reservoir base plate 42) and slightly shorter than that of each reservoir base plate 42. Both ends of each reservoir base plate 42 protrude outward in the main scanning direction beyond corresponding ends of the platen 19, respectively. These portions of each reservoir base plate 42, which protrude outward in the main scanning direction beyond the platen 19, are fixed to the pair of holders 3, respectively.

A surface of the platen 19 is a support surface which supports: the upper loop of the conveyor belt 8 from the inner periphery of the conveyor belt 8; and a sheet P via the conveyor belt 8. As shown in FIG. 4, the width of the conveyor belt 8 is shorter than the width of the platen 19 (the length in the main scanning direction). In the surface of the platen 19, a middle region sandwiched between both end areas in the main scanning direction, is covered with the conveyor belt 8, and the above-mentioned both end areas are uncovered. The elastic members 20 are disposed in these uncovered end areas.

As shown in FIG. 4, two elastic members 20 are provided to each head 10 so that the two elastic members 20 respectively correspond the both ends of each head 10 in the main scanning direction. As shown in FIG. 5B, the elastic members 20 are fixed on the surface of the platen 19 in such a manner that two elastic members 20 respectively face both ends of each head 10 in the main scanning direction (in this embodiment, the elastic members 20 are fixed at distal ends of the platen 19 in the main scanning direction).

In a plan view shown in FIG. 4, each elastic member 20 is substantially quadrangular and its length in the sub scanning direction is slightly longer than the width of each head 10 (the length in the sub scanning direction). The length of each elastic member 20 in the main scanning direction is slightly shorter than that of each end area of the surface of the platen 19, which is mentioned above and uncovered with the conveyor belt 8, and is slightly longer than the length of each gradient 10*x* in the main scanning direction, as shown in FIG. 5A. Each elastic member 20 has a section formed by cutting away a portion of a rectangle, which section is constant from one end to the other end in the sub scanning direction. Each elastic member 20 abuts the recording surface, the corresponding gradient 10*x*, and an under surface of the reservoir base plate 42 parallel to the recording surface, of the corresponding head 10.

As shown in FIG. 5A, each elastic member 20 includes: an abutment 20*a* which abuts the corresponding recording surface; a gradient surface 20*b* which is inclined at the same angle as the inclination angle θ of each gradient 10*x* so as to abut the corresponding gradient 10*x*; and an upper surface 20*c* which abuts the under surface of the corresponding reservoir base plate 42.

An upper surface of the abutment 20*a* abuts a neighborhood of corresponding one of both ends of the recording surface in the main scanning direction, and an under surface of the abutment 20*a* abuts the surface of the platen 19. The abutment 20*a* has a thickness t constant from one end to the other end in the sub scanning direction, which is grater than a thickness of the conveyor belt 8 (the thickness t is equal to the distance between the recording surface of each head 10 at the recording position shown in FIG. 5A and the surface of the platen 19). This creates a constant gap d between the recording surface of each head 10 and the surface of the conveyor belt 8, at the time of recording. A sheet P having been conveyed while being placed on the conveyor belt 8 faces the recording surfaces with a gap therebetween, which is smaller than the gap d by a thickness of the sheet P. In this state, the sheet P receives recording made by ink ejected from the ejection openings of the recording surfaces.

While the gradient surface 20*b* of each elastic member 20 is flat, the gradient 10*x* of each head 10 has a stair-like configuration (in this embodiment, horizontal surfaces parallel to the recording surfaces and vertical surfaces perpendicular to the horizontal surfaces are continuously and alternately provided). Therefore, each gradient surface 20*b* contacts the corresponding gradient 10*x*, achieving line contact not surface contact. That is, in the cross section of FIG. 5A, the gradient surface 20*b* does not contact the whole gradient 10*x*, but contacts a corner at an end of each of the plates constituting the gradient 10*x*, which corner acts as a boundary between an under surface and a side surface of each plate.

As described above, in this embodiment, each elastic member 20 interposed between the corresponding head 10 and the platen 19 abuts the recording surface of the head 10 and the under surface of the corresponding reservoir base plate 42 parallel to the recording surface. This structure dampens vibration in the direction perpendicular to the recording surfaces (the up-down direction). Furthermore, since each elastic member 20 also abuts the corresponding gradient 10*x*, it is possible to effectively dampen vibration in a direction parallel to the recording surfaces (the main scanning direction). Thus, vibration is effectively dampened in both directions of: the direction perpendicular to the recording surfaces; and the direction parallel to the recording surfaces. This enhances an effect of preventing degradation in recording quality.

Each of the line heads 10 is supported, at its both ends in its longitudinal direction, by the platen 19 via the corresponding elastic members 20. Each gradient 10*x* is inclined relative to the corresponding recording surface in the section shown in FIG. 5A. This effectively dampens vibration in the longitudinal direction of each head 10 (i.e., the main scanning direction). The gap between each recording surface and a sheet P at the time of recording is defined by the thickness t, which is the thickness of the abutment 20*a* of each elastic member 20 disposed on the support surface of the platen 19. Accordingly, there is no need to provide another member for defining the gap, and it is possible to simplify the structure of the apparatus.

In the case of line heads, the heads 10 may be moved from the recording position to the withdrawal position at the time other than recording (e.g., at the time of maintenance), and then moved to the recording position again at the time of recording. In this embodiment, the controller 100 moves the heads 10 downward from the withdrawal position to place the heads 10 at the recording position. Simultaneously with this, a gap between the recording surfaces and a sheet P is defined by the thickness t of the abutment 20*a* of each elastic member 20. Therefore, it is not necessary to perform a process for defining the gap separately, and this improves the speed of processing.

As shown in FIG. 5A, each elastic member 20 abuts the corresponding recording surface, the corresponding gradient 10*x*, and the under surface of the corresponding reservoir base plate 42, which are contiguous to one another in the main scanning direction. Thus, each elastic member 20 abuts such a contiguously formed portion of the corresponding head 10. This enhances the effect of dampening vibration of the heads 10 brought by the elastic members 20.

Each head 10 is formed of plates stacked on top of one another, which is relatively easy to manufacture. Using ends of the plates 22 to 30 whose lengths have been adjusted, each gradient 10*x* is easily formed.

Figure 6:
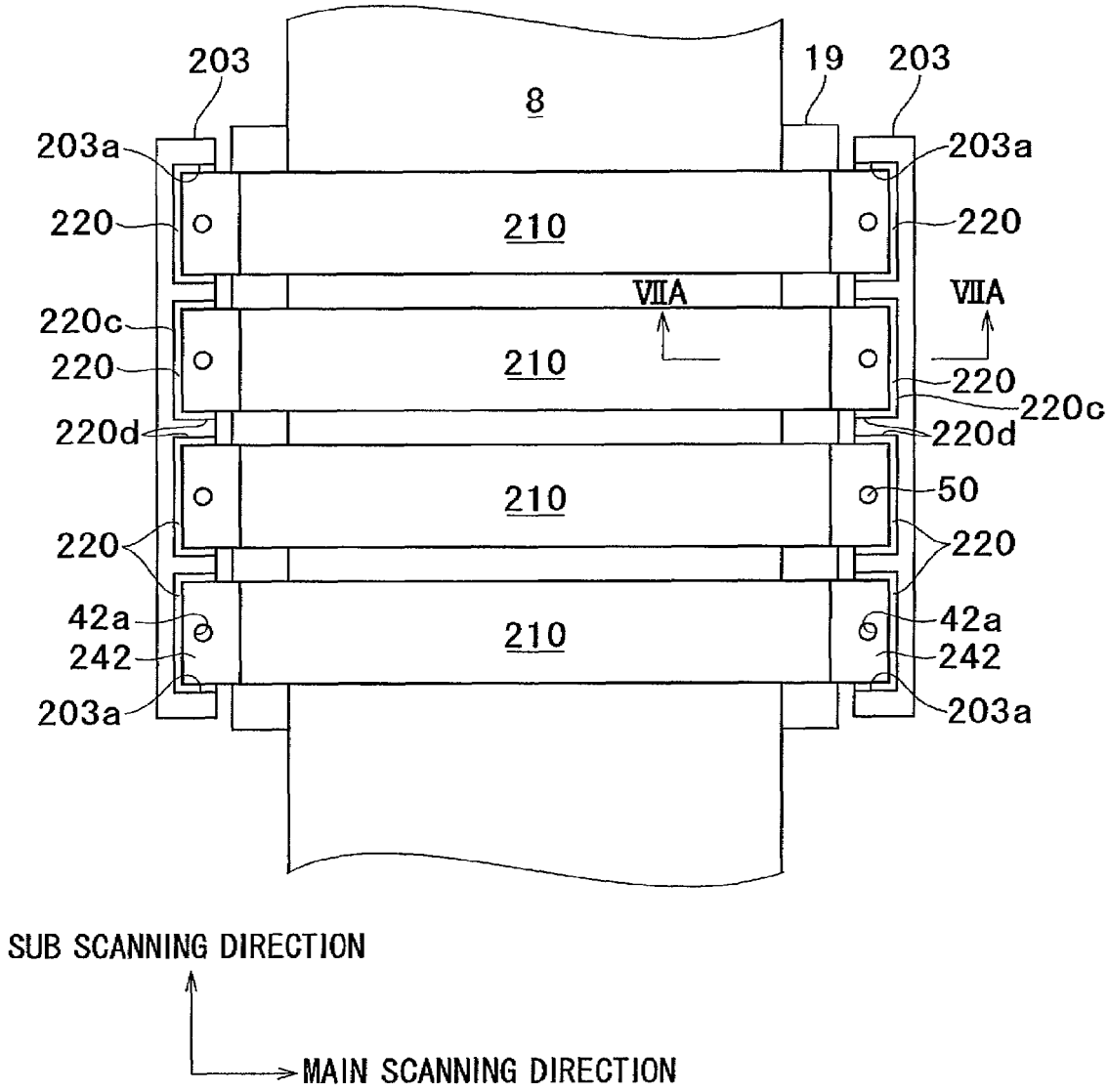
FIG. 6 is a plan view illustrating a region where four heads are disposed in an ink jet printer of a second embodiment of the present invention.
Figure 7A:
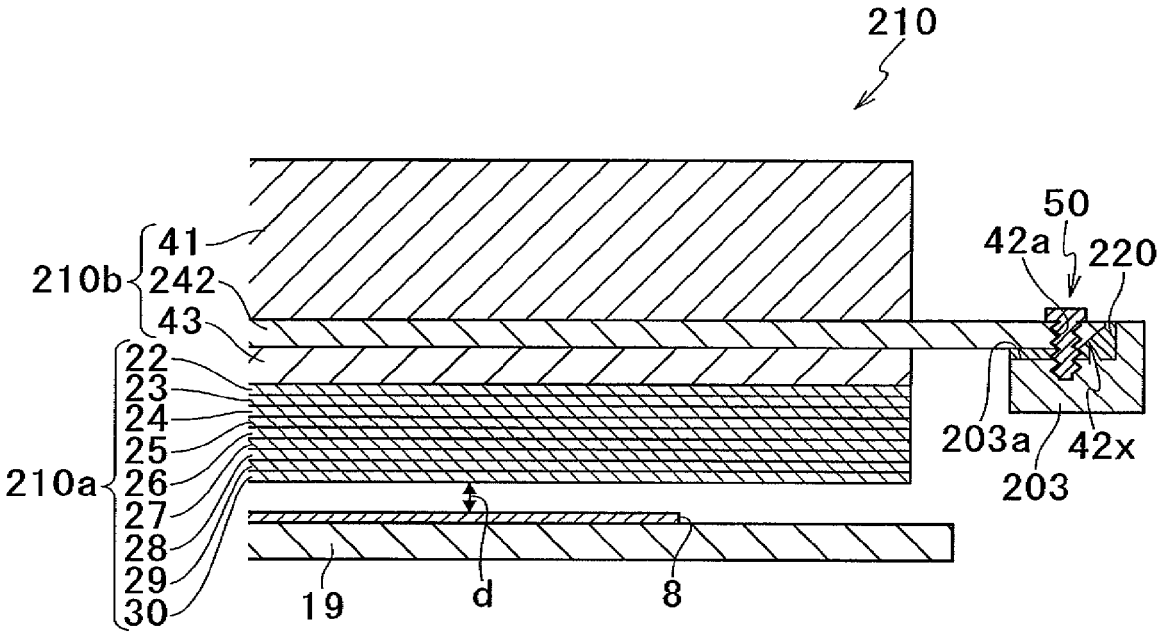
FIG. 7A is a sectional view taken along line VIIA-VIIA of FIG. 6, illustrating a state where the heads are in a recording position.
Figure 7B:
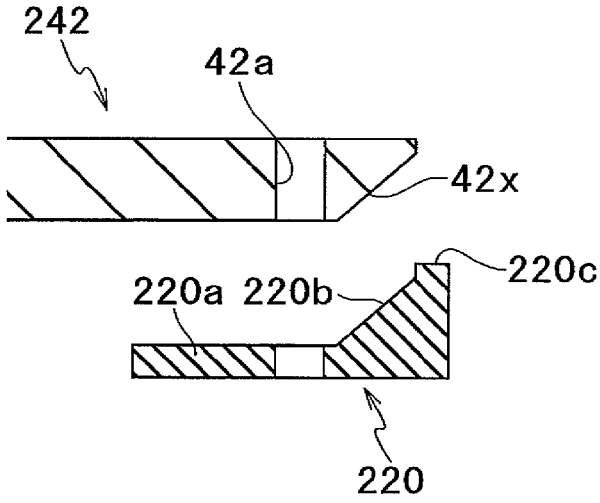
FIG. 7B is a partial sectional view illustrating an end of a reservoir base plate and an elastic member separately, which are shown in FIG. 7A.

The following describes a second embodiment of the present invention with reference to FIGS. 6, 7A, and 7B. Hereinafter, the same components as in the first embodiment will be given the same reference numerals, and the description thereof will be omitted.

As shown in FIG. 7A, in the second embodiment, the gradients 10*x*(see FIG. 5A) as in the first embodiment are not provided to a passage unit 210*a* of each head 210, but gradients 42*x* are provided at both ends of a reservoir base plate 242 in a main scanning direction, of each reservoir unit 210*b*. Similarly to the reservoir base plates 42 of the first embodiment, each reservoir base plate 242 has a longer length in the main scanning direction than other members 41, 43, and 210*a* constituting the corresponding head 210. In addition, each reservoir base plate 242 is further apart from a sheet P in an up-down direction than a recording surface of the corresponding head 210 (each reservoir base plate 242 is above the corresponding recording surface), and protrudes outward in the main scanning direction beyond the recording surface.

Both upper and lower surfaces of each reservoir base plate 242 are flat surfaces parallel to the corresponding recording surface (an under surface of a plate 30). Neighborhoods of respective lower corners at both ends of each plate 242 in the main scanning direction (the lower corners mean corners of each plate 242, each functioning as a boundary between its lower surface and each end surface in the main scanning direction) are cut away, and thereby the gradients 42*x* are formed. Each of the gradients 42*x* is inclined at approximately 45 degrees relative to the corresponding recording surface.

As shown in FIG. 6, holders 203 have similar structure to the holders 3 of the first embodiment. That is, the holders 203, each of which is a rod-like member having its length in a sub scanning direction, are respectively disposed on both sides of a conveyor belt 8 and a platen 19 in the main scanning direction so as to sandwich the conveyor belt 8 and the platen 19 in a plan view. Further, the holders 203 are supported by a housing of a printer via a not-shown up-down movement mechanism in such a manner that the holders 203 are movable in the up-down direction (a direction perpendicular to the recording surfaces). As a controller 100 controls the not-shown up-down movement mechanism so as to drive, the pair of holders 203 holding the heads 210 are moved in the up-down direction, and thereby the four heads 210 are also moved relative to the housing in the up-down direction. Similarly to the first embodiment, this enables the heads 210 to selectively take: a recording position where a gap d is created between the recording surfaces and a surface of the conveyor belt 8 (as shown in FIG. 7A); and a withdrawal position which is above the recording position.

The pair of holders 203 differ from the holders 3 of the first embodiment in that each holder 203 includes recesses 203*a* each creating a space for receiving corresponding one of the above-mentioned ends of the reservoir base plate 242 of each head 210. Each holder 203 is provided with four recesses 203*a* spaced apart at regular intervals in the sub scanning direction. Each of the recesses 203*a* is quadrangular in a plan view, and is a space having openings on an upper surface and inner side surface in the main scanning direction (a side surface closer to the conveyor belt 8 in a plan view of FIG. 6) of the corresponding holder 203. As shown in FIG. 7A, each recess 203*a* is formed by notching a neighborhood of an upper corner closer to the belt 8 of the corresponding holder 203 (that is, a corner of the holder 203, which functions as a boundary between its upper surface and inner side surface in the main scanning direction).

In the first embodiment, the elastic members 20 are disposed on the platen 19. However, in this embodiment, elastic members 220 are not disposed on the platen 19 but disposed in the respective recesses 203*a* of the holders 203.

In a corresponding recess 203*a*, each elastic member 220 is interposed among and held by: side walls defining the recess 203*a* of the corresponding holder 203; and an end of the corresponding reservoir base plate 242 in the main scanning direction (hereinafter simply referred to as "end(s) of the reservoir base plate 242"). In other words, the holders 203 do not directly contact the respective ends of each reservoir base plate 242, and the elastic members 220 are disposed so as to fill respective gaps between them.

In a plan view of FIG. 6, each elastic member 220 has an approximate U-shape which covers the periphery of an end of the corresponding reservoir base plate 242. Each elastic member 220 has one side part 220*c* and two side parts 220*d*. The side part 220*c* is interposed between and held by: an end surface of the corresponding reservoir base plate 242 in the main scanning direction; and a side wall which defines the corresponding recess 203*a* of the corresponding holder 203 and extends along the sub scanning direction. The two side parts 220*d* are interposed between and held by: (i) respective side surfaces of an end of the reservoir base plate 242, which surfaces extend along the main scanning direction, and (ii) respective side walls which define the recess 203*a* of the holder 203 and extend along the main scanning direction. The side part 220*c* extends along the sub scanning direction, and each side part 220*d* extends along the main scanning direction.

Further, as shown in FIGS. 7A and 7B, each elastic member 220 has a base 220*a* and a gradient surface 220*b*. The base 220*a* is interposed among and held by: an under surface of an end of the corresponding reservoir base plate 242; and side walls defining a bottom surface of the corresponding recess 203*a* in the corresponding holder 203. The gradient surface 220*b* is provided between the base 220*a* and the side part 220*c*, and is inclined at the same angle as an inclination angle of the corresponding gradient 42*x*. Thus, the elastic members 220 are provided at both ends of each reservoir base plate 242 in the main scanning direction, between the respective holders 203 and each reservoir base plate 242, and each elastic member 220 abuts the under surface of the corresponding plate 242 and the corresponding gradient 42*x*.

As shown in FIGS. 7A and 7B, each base 220*a* is provided with a through hole which corresponds to a through hole 42*a* of the associated plate 242. With screws 50 or the like inserted into these through holes, each reservoir base plate 242 is fixed to the holders 203 via the elastic members 220. Thereby, the whole heads 210 are held by the holders 203.

As described above, in this embodiment, each elastic member 220 abuts: the under surface of the corresponding reservoir base plate 242 parallel to the recording surfaces; and the gradient 42*x* formed on the plate 242. This provides an effect similar to that of the first embodiment, that is, the effect of effectively dampening vibration in the direction perpendicular to the recording surfaces (the up-down direction) and in the direction parallel to the recording surfaces (the main scanning direction).

In the above first embodiment, each elastic member 20 is configured to abut the recording surface of the corresponding head 10, and therefore it is necessary to increase a size of a portion in the recording surface which is not the ejection region (in FIG. 3, portions outside the regions of respective actuator units 21 located outermost in the main scanning direction). This may results in a problem of increase in size of the heads. On the other hand, in the second embodiment, each elastic member 220 does not abut the recording surface of the corresponding head 210 but abuts the under surface of the corresponding reservoir base plate 242 and the corresponding gradient 42*x*. Accordingly, there is no need to increase the size of the above portion, and this helps to avoid the problem of increase in size of the heads.

In the first place, each reservoir base plate 242 is formed to be longer in the main scanning direction in order to fix the corresponding head 210 to the holders 203. Therefore, it is easy to secure a large abutting area between each reservoir base plate 242 and the corresponding elastic member 220. Accordingly, it is possible to relatively easily enhance the effect of dampening vibration.

Since the elastic members 220 are disposed in the respective recesses 203*a* of the holders 203, it is possible to achieve appropriate positioning of the elastic members 220 in the holders 203.

Furthermore, each elastic member 220 is interposed among and held by: side walls defining the corresponding recess 203*a* in the corresponding holder 203; and the corresponding reservoir base plate 242. This makes it possible to more effectively dampen vibration in directions parallel to the recording surfaces (the main scanning direction and the sub scanning direction).

Figure 8:
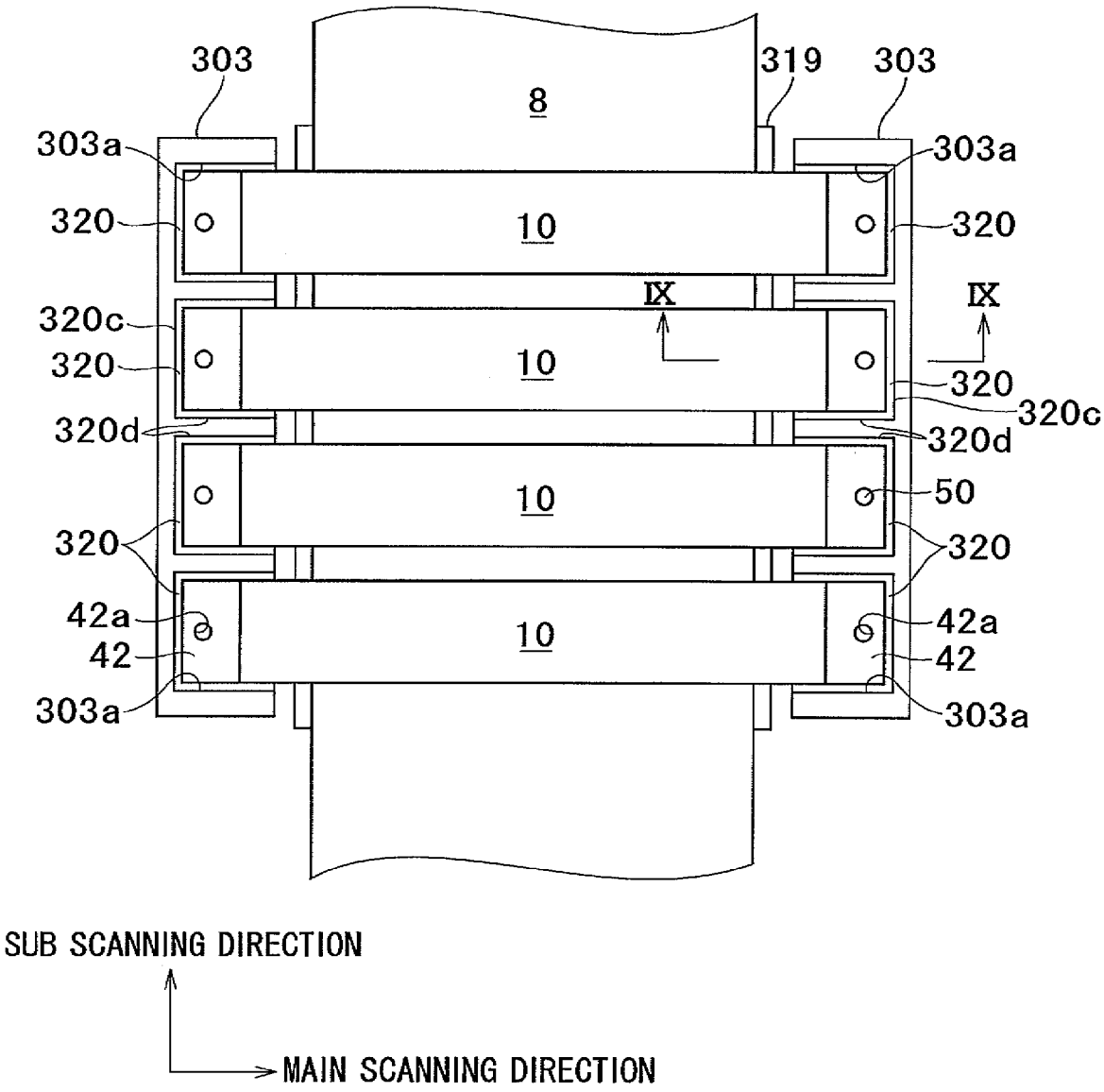
FIG. 8 is a plan view illustrating a region where four heads are disposed in an ink jet printer of a third embodiment of the present invention
Figure 9:
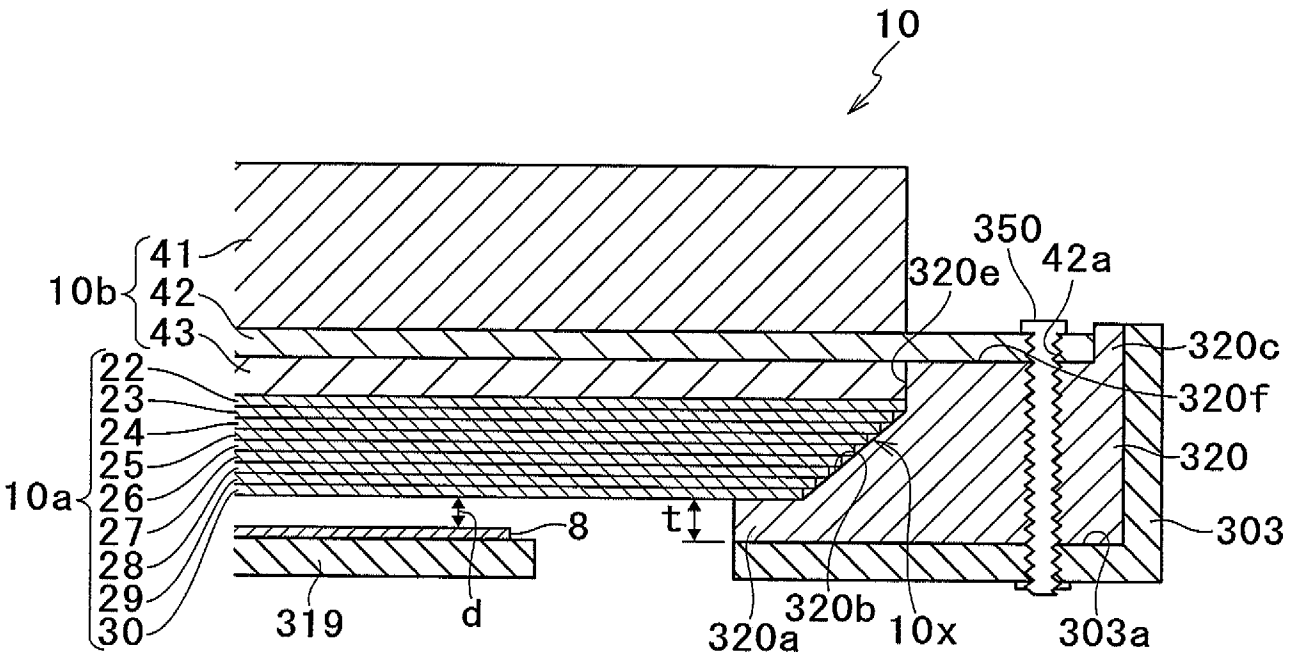
FIG. 9 is a sectional view taken along line IX-IX of FIG. 8, illustrating a state where the heads are in a recording position.

The following describes a third embodiment of the present invention with reference to FIGS. 8 and 9. Hereinafter, the same components as in the first embodiment will be given the same reference numerals and the description thereof will be omitted.

As shown in FIG. 9, each head 10 of the third embodiment has a similar structure as that of the first embodiment (see FIG. 5A), and gradients 10*x* are provided to each passage unit 10*a*.

In the first embodiment, the elastic members 20 are disposed on the platen 19. However, in this embodiment, elastic members 320 are not disposed on a platen 319 but are disposed in respective recesses 303*a* of holders 303. The elastic members 320 are provided so as to abut the respective gradients 10*x* formed on the passage unit 10*a* of each head 10. Therefore, the platen 319 of this embodiment has a shorter length in a main scanning direction than the platen 19 of the first embodiment shown in FIG. 5A.

As shown in FIG. 8, the holders 303 have similar structure to the holders 3 of the first embodiment. That is, the holders 303, each of which is a rod-like member having its length in a sub scanning direction, are respectively disposed on both sides of a conveyor belt 8 and the platen 319 in the main scanning direction so as to sandwich the conveyor belt 8 and the platen 319. Further, the holders 303 are supported by a housing of a printer via a not-shown up-down movement mechanism in such a manner that the holders 303 are movable in an up-down direction (a direction perpendicular to recording surfaces). As a controller 100 controls the not-shown up-down movement mechanism so as to drive, the pair of holders 303 holding the heads 10 are moved in the up-down direction, and thereby the four heads 10 are also moved relative to the housing in the up-down direction. Similarly to the first embodiment, this enables the heads 10 to selectively take a recording position shown in FIG. 9 and a withdrawal position which is above the recording position.

The pair of holders 303 differ from the holders 3 of the first embodiment in that each holder 303 has recesses 303*a*. Each of the recesses 303*a* creates a space for receiving: a portion of a reservoir base plate 42 protruding at an end of the corresponding head 10 in the main scanning direction; and a corresponding gradient 10*x* including its neighborhood. Similarly to the recesses 203*a* of the second embodiment, four recesses 303*a* spaced apart at regular intervals in the sub scanning direction are provided to each holder 303. In addition, each recess 303*a* is quadrangular in a plan view, and is a space having openings on an upper surface and an inner side surface in the main scanning direction (a side surface closer to the conveyor belt 8, in a plan view of FIG. 8) of the corresponding holder 303. As shown in FIG. 9, each recess 303*a* is formed by notching a neighborhood of an upper corner closer to the belt 8 of the corresponding holder 303 (that is, a corner of the holder 303, which functions as a boundary between its upper surface and inner side surface in the main scanning direction).

Compared to each holder 3 of the first embodiment or each holder 203 of the second embodiment, each holder 303 is longer in the main scanning direction, that is, has a greater width. Each recess 303*a* is also longer in the main scanning direction than each recess 203*a* of the second embodiment. This is because each recess 303*a* receives not only an end of the corresponding reservoir base plate 42 but also the corresponding gradient 10*x* formed at a side of the corresponding passage unit 10*a*. On the other hand, each recess 203*a* (see FIG. 7A) of the second embodiment receives an end of the corresponding reservoir base plate 242 only.

In the corresponding recess 303*a*, each elastic member 320 is interposed among and held by: side walls defining the recess 303*a* in the corresponding holder 303; and an end of the corresponding head 10 (specifically, an end of the corresponding reservoir base plate 42 and the corresponding gradient 10*x*). In other words, the holders 303 do not directly contact the respective ends of each head 10, and the elastic members 320 are disposed so as to fill respective gaps between them.

In a plan view of FIG. 8, each elastic member 320 has an approximate U-shape which covers the periphery of an end of the corresponding head 10 in the main scanning direction. Each elastic member 320 has a side part 320*c* and two side parts 320*d*. The side part 320*c* is interposed between and held by: an end surface of the corresponding reservoir base plate 42 in the main scanning direction; and a side wall which defines the corresponding recess 303*a* in the corresponding holder 303 and extends along the sub scanning direction. The two side parts 320*d* are interposed between and held by: (i) respective side surfaces of an end of the corresponding head 10, which surfaces extend along the main scanning direction; and (ii) respective side walls which define the recess 303*a* in the holder 303 and extend along the main scanning direction.

The side part 320*c* extends along the sub scanning direction, and each of the side parts 320*d* extends along the main scanning direction.

Further, as shown in FIG. 9, each elastic member 320 has: a base 320*a*; a gradient surface 320*b* contiguous to the base 320*a*; a vertical surface 320*e* extending vertically from an upper end of the gradient surface 320*b*; and a horizontal surface 320*f* extending horizontally from an upper end of the vertical surface 320*e*. The base 320*a* is interposed among and held by: an under surface of an end of the corresponding passage unit 10*a* in the main scanning direction; and side walls defining a bottom surface of the corresponding recess 303*a* in the corresponding holder 303. The base 320*a* has a thickness t which is constant from one end to the other end in the sub scanning direction. The gradient surface 320*b* is inclined relative to the recording surfaces at the same angle as an inclination angle of the corresponding gradient 10*x*. The vertical surface 320*e* abuts: an end surface of a corresponding plate 22 in the main scanning direction; and an end surface of a corresponding lower reservoir 43 in the main scanning direction. The horizontal surface 320*f* abuts an under surface of a portion of the corresponding reservoir base plate 42 which protrudes, in the main scanning direction, beyond the plates 41 and 43. The side part 320*c* protrudes upward from the horizontal surface 320*f*.

Thus, at both ends of each head 10 in the main scanning direction, the elastic members 320 are interposed between each head 10 and respective holders 303, and each elastic member 320 abuts: the corresponding recording surface; the corresponding gradient 10*x*; a side surface of the corresponding head 10, which surface is above the gradient 10*x* but below the corresponding reservoir base plate 42; and the reservoir base plate 42.

As shown in FIG. 9, each elastic member 320 has a through hole corresponding to a through hole 42*a* of the associated plate 42, and the holders 303 also have through holes respectively corresponding to the through holes 42*a* of the plates 42. With screws 350 or the like inserted into these through holes, the reservoir base plates 42 are fixed to the holders 303 via the elastic members 320. Thereby, the whole heads 10 are held by the holders 303.

As described above, in this embodiment, each elastic member 320 abuts not only the recording surface of the corresponding head 10 and the under surface of the corresponding reservoir base plate 42 which is parallel to the recording surface, but also the corresponding gradient 10*x*. This provides an effect similar to that of the first embodiment, that is, the effect of effectively dampening vibration in both directions of: the direction perpendicular to the recording surfaces (the up-down direction); and the direction parallel to the recording surfaces (the main scanning direction).

As shown in FIG. 9, each elastic member 320 abuts the following areas contiguous to one another in the main scanning direction: the corresponding recording surface; the corresponding gradient 10*x*; a side surface of the corresponding head 10, which surface is above the gradient 10*x* but below the corresponding reservoir base plate 42; the under surface of the reservoir base plate 42; and the corresponding end surface of the plate 42. In other words, each elastic member 320 of this embodiment abuts the corresponding head 10 with a larger contact area compared to that in the first or second embodiment. Since each elastic member 320 abuts such a contiguously formed portion of the corresponding head 10 with a large contact area, an effect of dampening vibration of the heads 10, which is brought by the elastic members 320, is enhanced.

Since the elastic members 320 are disposed in the respective recesses 303*a* of the holders 303, an effect similar to that of the second embodiment is obtained, that is, it is possible to achieve appropriate positioning of the elastic members 320 in the holders 303.

Furthermore, each elastic member 320 is interposed among and held by: side walls defining the corresponding recess 303*a* in the corresponding holder 303; and the corresponding reservoir base plate 42. This provides an effect similar to that of the second embodiment, that is, it is possible to more effectively dampen vibration in directions parallel to the recording surfaces (the main scanning direction and the sub scanning direction).

Note that, in the first and third embodiments, each gradient 10*x* may be a flat surface, for example, inclined in the same way as the gradient surface 20*b* of the corresponding elastic member 20. In this case, the contact achieved between the gradient and the elastic member is not line contact, but surface contact.

In the first and third embodiments, the gradient surface 20*b* of each elastic member 20 may have a stair-like configuration which engages the corresponding gradient 10*x*.

In the second embodiment, each gradient 42*x* may have a stair-like configuration like each gradient 10*x* of the first or third embodiment. In this case, the gradient surface 220*b* of each elastic member 220 may also have a stair-like configuration which engages the corresponding gradient of the stair-like configuration.

In the first embodiment, the gradient surface 20*b* of each elastic member 20 may contact all of, or a part of, the corners constituting the stair-like configuration of the corresponding gradient 10*x*.

In the present invention, the whole region of, or a part of a gradient may contact a vibration damper.

In the first to third embodiments, the gradients are provided at both ends of each head in its longitudinal direction (the main scanning direction), and therefore the elastic members which abut the respective gradients dampen vibration in the main scanning direction. However, the gradients may be provided at both ends of each head in its width direction (the sub scanning direction). In this case, the elastic members dampen vibration in the sub scanning direction.

The present invention is not limited to the configuration such that one or more heads are capable of selectively taking the recording position and the withdrawal position. For example, the heads may be always held in the recording position without taking the withdrawal position.

Each head does not have to be formed of plates stacked on top of one another. Each head may be formed by die-casting, for example.

The vibration damper is merely required to abut (i) at least one of the recording surface and a surface parallel to the recording surface of the recording head, and (ii) the gradient. That is, the vibration damper does not have to abut other portions of the head which are not described above. For example, in the first embodiment, the upper surface 20*c* of each elastic member 20 abuts the under surface of the corresponding reservoir base plate 42, however, the upper surface 20*c* does not have to abut the under surface. Further, in the first embodiment, a side surface of each elastic member 20, which vertically extends between the gradient surface 20*b* and the upper surface 20*c*, contacts a side surface of the corresponding plate 22 with no gap therebetween. However, a gap may exist between them.

In the second and third embodiments, each elastic member 220, 320 is interposed among and held by: the side walls defining the corresponding recess 203*a* in the corresponding holder 203, 303; and the corresponding reservoir base plate 242, 42. However, the present invention is not limited to this structure. There may be a gap between each elastic member 220, 320 and any of the above side walls of the holder 203, 303, or between each elastic member 220, 320 and the corresponding reservoir base plate 242, 42. For example, even if the side parts 220*d* shown in FIG. 6 are not provided and there are gaps instead of the respective side parts 220*d*, side walls of the holders which walls define the corresponding recesses 203*a* and extend along the main scanning direction respectively face side surfaces of the ends of the reservoir base plates 242. Therefore, movement of each head 210 is restricted also in a direction regarding which the thus structured elastic members 220 fail to dampen vibration (i.e., the sub scanning direction), and as a result, degradation in recording quality is prevented.

In the second and third embodiments, the elastic members 220, 320 are disposed in the respective recesses 203*a*, 303*a* of the holders 203, 303. However, the present invention is not limited to this structure. For example, in the case where each holder 203, 303 does not have the recesses 203*a*, 303*a*, the elastic members 220, 320 may be fixed to the upper surface of each holder 203, 303.

The second embodiment may be configured so that: gradients 10*x* similar to those in the first embodiment are provided to each passage unit 210*a*; and elastic members corresponding to the respective gradients 10*x* are provided on the platen 19.

The vibration damper does not have to be the elastic members 20, 220, 320 as described in the above embodiments. Various types of members (for example, a cloth or a sheet such as KIMTOWELS®) may be used as a vibration damper, as long as such a member is capable of dampening vibration.

For the vibration damper, it is merely required that at least a portion of the vibration damper which abuts the recording head has the property of dampening vibration (e.g., elasticity). For example, in the above embodiments, a portion of each elastic member 20, 220, 320, which does not abut the corresponding head 10 may be a rigid body. When a cloth or a sheet such as KIMTOWELS® is used as a vibration damper, a support member which supports the cloth or sheet may be a rigid body or an elastic body.

The number of heads included in a recording apparatus is not limited to four and may be one or more.

The recording apparatus of the present invention may have a head other than an ink-jet head, for example, a thermal head or a dot impact head, and may conduct recording using liquid other than ink. In addition, the recording apparatus of the present invention may have a line head or a serial head, and is applicable to various recording devices other than a printer, such as a facsimile machine, copy machine, and the like.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus comprising:

a conveyor unit configured to convey a printing medium in a conveyance direction;

a line recording head comprising a recording surface which has an ejection opening for ejecting liquid and faces the printing medium conveyed by the conveyor unit, and a pair of gradients, each of which is disposed at an end of the recording surface and is inclined relative to the recording surface, the recording head being longer than a width of the printing medium in a direction orthogonal to the conveyance direction and conducting recording onto the printing medium while being fixed;

a supporter which supports the recording head at a recording position;

a pair of vibration dampers, each of which is interposed between the recording head and the supporter and abuts: at least one of the recording surface and a surface parallel to the recording surface of the recording head; and one of the pair of gradients; and a platen comprising a supporting surface that supports the printing medium at a position opposing the recording surface, the pair of gradients being disposed at respective ends of the recording head in a direction orthogonal to the conveyance direction, wherein the pair of gradients are disposed such that the printing medium, when conveyed, is disposed between the pair of gradients in the direction orthogonal to the conveyance direction, each of the gradients being inclined outward, in a direction orthogonal to the recording surface and away from the platen toward the recording surface, from the center of the recording head in the direction orthogonal to the conveyance direction, and directions of inclination of each of the gradients intersecting each other, and wherein the pair of vibration dampers are disposed such that the printing medium, when conveyed, is disposed between the pair of vibration dampers in the direction orthogonal to the conveyance direction, to correspond to the pair of gradients.

2. The recording apparatus according to claim 1, wherein:

the supporter is the platen each of the vibration dampers is positioned on the support surface of the platen in such a manner that the vibration damper faces each end of the recording head in the direction orthogonal to the conveyance direction, and the vibration damper abuts the recording surface and the gradient; and a thickness, in a direction perpendicular to the recording surface, of a portion of the vibration damper which abuts the recording surface is equal to a distance between the recording surface and the support surface at the recording position.

3. The recording apparatus according to claim 2, further comprising a movement unit which moves the recording head in the direction perpendicular to the recording surface so that the recording head is capable of selectively taking: the recording position where the recording head is supported by the platen; and a withdrawal position where the recording head is not supported by the platen.

4. The recording apparatus according to claim 1, wherein the vibration damper abuts the recording surface, the gradient, and the surface parallel to the recording surface, which are contiguous to one another.

5. The recording apparatus according to claim 1, wherein:

the recording head includes a first plate including the recording surface, and one or more second plates stacked on a surface of the first plate opposite to the recording surface, each second plate having an end protruding outward beyond a corresponding end of a plate which is adjacent thereto at a side closer to the recording surface; and the gradient is formed of the ends of the first and second plates into a stair-like configuration.

6. The recording apparatus according to claim 1, wherein:

the recording head includes a protrusion, which is further apart from the printing medium conveyed by the conveyor unit than the recording surface in a direction perpendicular to the recording surface and protrudes outward beyond the recording surface, the protrusion being provided with the surface parallel to the recording surface and the gradient; and the vibration damper abuts the surface parallel to the recording surface and the gradient which are provided to the protrusion.

7. The recording apparatus according to claim 6, wherein:

the supporter includes a recess which creates a space for receiving the protrusion; and the vibration damper is positioned in the recess.

8. The recording apparatus according to claim 7, wherein the vibration damper is interposed among and held by: side walls each defining the recess of the supporter; and the protrusion.

9. A recording apparatus comprising:

a conveyor unit configured to convey a printing medium in a conveyance direction;

a line recording head comprising a recording surface which has an ejection opening for ejecting liquid and faces the printing medium conveyed by the conveyor unit, and a pair of gradients each of which is disposed at an end of the recording surface and is inclined relative to the recording surface, the recording head being longer than the width of the printing medium in a direction orthogonal to the conveyance direction and conducting recording onto the printing medium while being fixed;

a supporter which supports the recording head at a recording position;

a pair of vibration dampers each of which is interposed between the recording head and the supporter and abuts: at least one of the recording surface and a surface parallel to the recording surface of the recording had; and one of the pair of gradients;

a platen comprising a supporting surface that supports the printing medium at a position opposing the recording surface; and a movement unit which moves the recording head in the direction orthogonal to the recording head to cause the recording head to be at either the recording position or a withdrawal position for maintenance, the withdrawal position being farther from the platen than the recording position in the direction orthogonal to the recording surface, the pair of gradients being disposed at respective ends of the recording head in a direction orthogonal to the conveyance direction, wherein the pair of gradients are disposed such that the printing medium, when conveyed, is disposed between the pair of gradients in the direction orthogonal to the conveyance direction, each of the gradients being inclined outward, in a direction which is orthogonal to the recording surface and away from the platen toward the recording surface, from the center of the recording head in the direction orthogonal to the conveyance direction, and directions of inclination of each of the gradients intersecting each other, and wherein the pair of vibration dampers are disposed such that the printing medium, when conveyed, is disposed between the pair of vibration dampers in the direction orthogonal to the conveyance direction, to correspond to the pair of gradients, an edge portion of each of the gradients that is closer to the center of the recording head in the direction orthogonal to the conveyance direction being connected to one of: the recording surface and a surface in parallel to the recording surface, and each of the vibration dampers having a gradient surface contacting a corresponding one of the gradients and a base that contacts one of the recording surface and a surface parallel to the recording surface, which is connected to the edge portion of the one of the gradients closer to the center of the recording head in the direction orthogonal to the conveyance direction.

* * * * *